US006233998B1

(12) United States Patent
Tseng

(10) Patent No.: US 6,233,998 B1
(45) Date of Patent: May 22, 2001

(54) EASY MODE PIPE-REDUCING DEVICE

(76) Inventor: Shao-Chien Tseng, No. 130, Sec. 2, Yang-Shin Rd., Yang-Mei 326 Taoyuan (TW)

( * ) Notice: Subject to any disclaimer, the term of this patent is extended or adjusted under 35 U.S.C. 154(b) by 0 days.

(21) Appl. No.: 09/526,256

(22) Filed: Mar. 16, 2000

(51) Int. Cl.[7] ..... B21D 7/00; B21D 51/10

(52) U.S. Cl. ..... 72/318; 72/370.02; 72/467

(58) Field of Search ..... 72/370.02, 370.03, 72/370.1, 467, 352, 318, 343, 274, 284

(56) References Cited

U.S. PATENT DOCUMENTS

| | | | | |
|---|---|---|---|---|
| 883,128 | * | 3/1908 | Bond | 72/343 |
| 4,383,429 | * | 5/1983 | Ceccacci | 72/318 |
| 4,578,985 | * | 4/1986 | Winter | 72/467 |

FOREIGN PATENT DOCUMENTS

| | | | | |
|---|---|---|---|---|
| 118981 | * | 9/1930 | (AU) | 72/467 |
| 611051 | * | 9/1936 | (DE) | 72/467 |
| 321017 | * | 10/1929 | (GB) | 72/467 |
| 170439 | * | 6/1994 | (JP) | 72/467 |

* cited by examiner

*Primary Examiner*—Daniel C. Crane
(74) *Attorney, Agent, or Firm*—Pro-Techtor International Services

(57) ABSTRACT

An easy mode pipe-diameter reducing device provided for feeding a metallic pipe into the hole confined by the wall surfaces of a conical spring mounted in the die bodies of the device, wherein, wall sections of the die bodies with constant diameter guides the metallic. pipe, and wall sections of the die bodies with tapering shapes contract the wall of the metallic pipe. Thereby, the peripheral pipe wall is gradually contracted under confining of the tapering wall surfaces of the die bodies. Wherein, the pipe-diameter reducing device is comprised of an upper die body and a lower die body having a conical spring provided therebetween, the inner diameter of the conical spring forms the wall surfaces extending from the wall sections with constant diameter to the tapered wall sections thereof. Therefore, when the metallic pipe is fed till it contacts the tapered wall sections, it can be contracted thereby into the shape of a tapered pipe. Hence easiness of pipe reducing can be achieved.

1 Claim, 4 Drawing Sheets

EASY MODE PIPE-REDUCING DEVICE

BACKGROUND OF THE INVENTION

1. Field of the Invention

The present invention is related to an easy mode pipe-diameter reducing device, and especially to such a device of which the inner wall is made with an inner thread thereon to extend from a section with constant diameter to a tapered section, in order to be benefit to feeding of the pipe into the die cavity of the device. With the threaded tapering wall to give surrounding pressing function for reducing the pipe diameter, a straight pipe can be easily formed into a pipe with reduced diameter, and easiness of pipe reducing can be achieved.

2. Description of the Prior Art

The metallic pipes used in the present invention can be divided into two groups: low carbon steel alloy pipes (such as steel pipes) and softer pipes made of nonferrous alloy (such as copper alloy pipes, aluminum alloy pipes and titanium alloy pipes). These metallic pipes normally are used in common mechanical structural members or piping members as supporting pipes or conveyer tubes. The pipes can be molded to be used as metallic rail pipes, metallic chair frame pipes, bicycle frame pipes, artistic decoration pipes etc. However, in manufacturing pipes for the abovementioned purposes, the pipes have to be bent or reduced in diameter.

Among the processes in the art relative to the technique of diameter reducing into conical shaped pipes, the preferred method is the rotary swaging, which reduces diameters of the pipes by swaging them into conical pipes. However, rotary swaging is suitable only for processing the above mentioned low carbon steel alloy pipes.

In known pipe-diameter reducing techniques, a U.S. Pat. No. 1,919,254 discloses a steel die provided with a plurality of die plates to produce thread like undulated pipes; a U.S. Pat. No. 3,492,849 discloses a steel die to gradually reduce diameters of pipes, and the steel die is provided therein with a plurality of rolling beads arranged in the form of a spiral thread, the rolling beads can be rolled along the thread to practice a technique of rotary swaging for making a spiral pipe; and a U.S. Pat. No. 3,727,443 discloses a die for pipes provided in a die cavity thereof with a plurality of rolling beads, each rolling bead in a recess can be individually adjusted, so that the rolling beads can be controlled to adjust the amount (degree) of pipe reducing by rotary swaging, in this way, a reduced pipe with a smooth surface can be obtained. If it is used to process the softer pipes made of nonferrous alloy, the pipes being processed are compressed by the rolling beads; by virtue that the pipes made of nonferrous alloy has insufficient strength for forming, the stress generated therein can not be uniformly scattered, thereby, the walls of the pipes are subjected to having rough edges looking like an orange skin as a whole. Pipe walls after being reduced into conical shaped pipes are not typically smooth. The structural complexity of a rotary swager and the higher cost of the equipment cause rotary swaged pipes to be uneconomic.

Therefore, in order to work on the low carbon steel alloy pipes and the softer pipes made of nonferrous alloy on the same equipment for reducing diameters to get smooth and fine pipe walls, conventional rotary swaging techniques do not suffice. It is difficult to obtain smooth pipe walls without rough edges or seams by other forming technique in the art also. The easy mode pipe-diameter reducing device of the present invention suits metallic pipes of low carbon steel alloy and nonferrous alloy more widely, the device itself is made to be simple for working, and this is the motive of studying and developing the present invention.

SUMMARY OF THE INVENTION

The object of the present invention is to provide an easy mode pipe-diameter reducing device of which the inner wall is made with an inner thread thereon to extend from a section with constant diameter to a tapered section, in order to be benefit to feeding of the pipe into the die cavity of the device. With the threaded tapering wall to give surrounding pressing function for reducing the pipe diameter, a metallic straight pipe can be easily and gradually contracted into a pipe with desired conic shape.

Aiming at this object, the present invention is outstanding by the following features:

1. It only needs to forward a pipe into a die cavity to be contracted with a constant speed, the diameter of the pipe can thereby be reduced; the process of such operation is simple and convenient.
2. The pipe reducing die cavity arranged in a screwing thread to uniformly scatter the stress and on the wall of the pipe during deformation by confining and diameter reducing and thereby reduce frictional resistance, so that the pipe wall of the diameter-reduced tapered pipe is smoothly and uniformly reduced in diameter, and the pipe wall is more bright and smooth.
3. A spiral threaded spring having a continual shank is used as an inner wall portion in the die cavity, during compressing and contracting on the pipe wall, the pipe being processed to form a tapered wall can at the same time be formed a seamless as well as smooth wall without rough edge, and quality of the wall of the shaped and reduced pipe can be improved.
4. The stress generated during pipe reducing is scattered by gradual pipe reducing operation mode following a conical spiral thread can reduce the degree of hardening of the metallic pipe during processing, and thereby pipe reducing ratio and pipe reducing speed can be increased and thus the quality and effect of production can be improved.

The present invention will be apparent after reading the detailed description of the preferred embodiment thereof in reference to the accompanying drawings.

DETAILED DESCRIPTION OF THE PREFERRED EMBODIMENT

Figure 1:
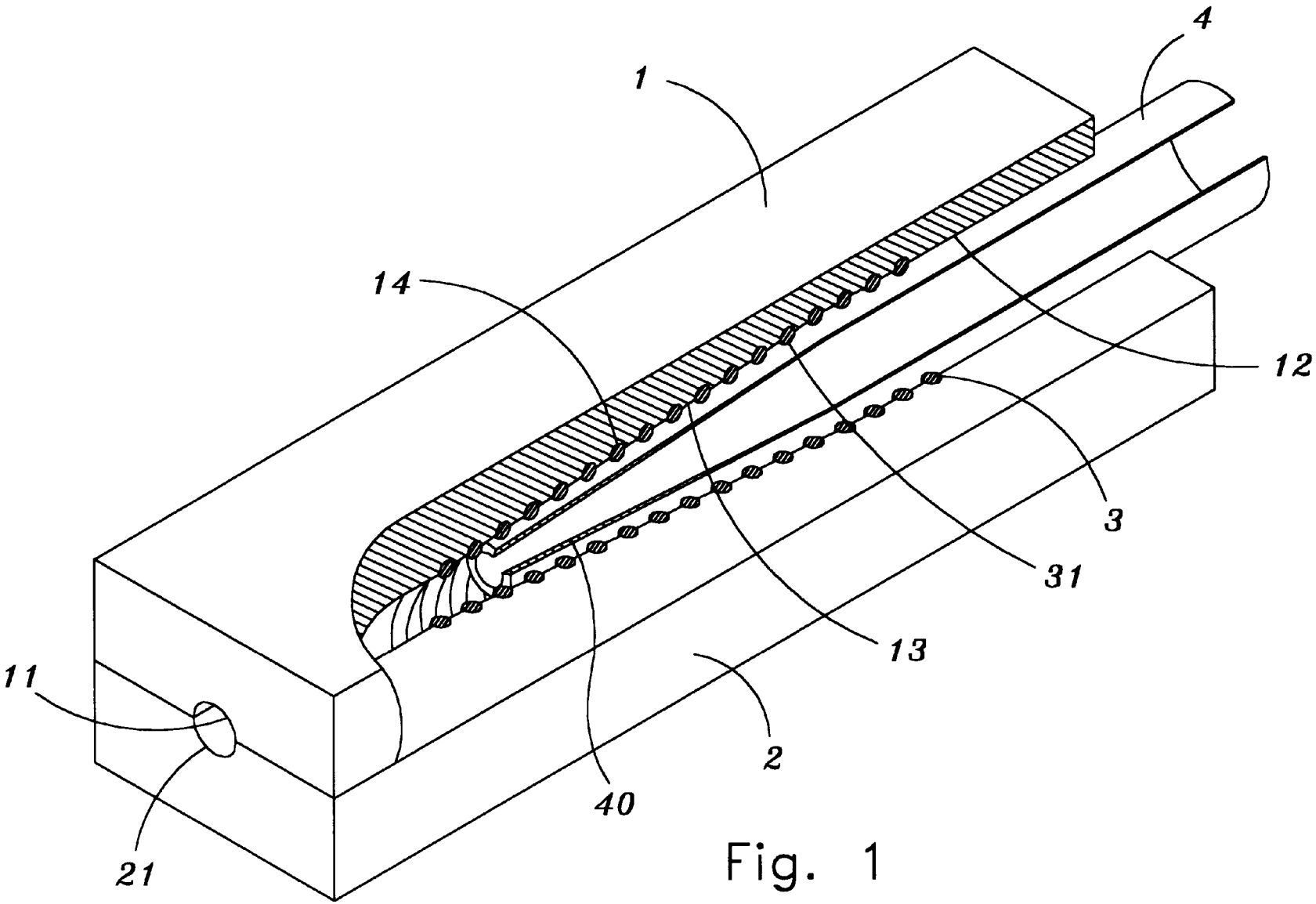
FIG. 1 is a partial broken perspective view of the present invention.

The easy mode pipe-diameter reducing device provided by the present invention, as is shown in FIG. 1, is comprised mainly of an upper die body 1 and a lower die body 2, and a conical spring 3 provided between the two.

Wherein, the upper die body 1 and the lower die body 2 are comprised respectively of half die-cavities 11 and 21 which each is tapered from a pair of wall sections 12 with constant diameter to a pair of tapered wall sections 13. The whole inner walls of the die bodies 1, 2 including the wall sections 12 and the other wall sections 13 are provided with a series of grooves 14 which are in the shapes of semi-circles in regard to their sections. Therefore, when the upper die body 1 and the lower die body 2 are closed to each other, the conical spring 3 is mounted in the semi-circular grooves 14 to be revealed from the inner wall of the half die-cavities 11 and 21 and extends from the wall sections 12 (now forming wall surfaces 31 of the conical spring 3 in the die bodies with constant diameter all along the sections) to the tapered wall sections 13 (now forming wall surfaces 32 of the conical spring 3 in the die bodies with tapering shapes). This is prepared for the procedure of diameter reducing on a metallic straight pipe 4.

Figure 2:
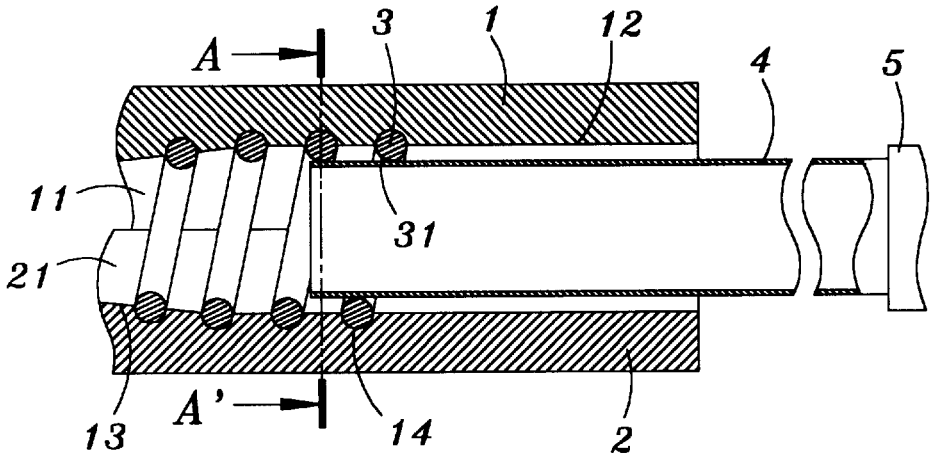
FIG. 2 is a sectional view showing the stage when the pipe is inserted in the end with constant diameter of the pipe-diameter reducing device of the present invention.
Figure 3:
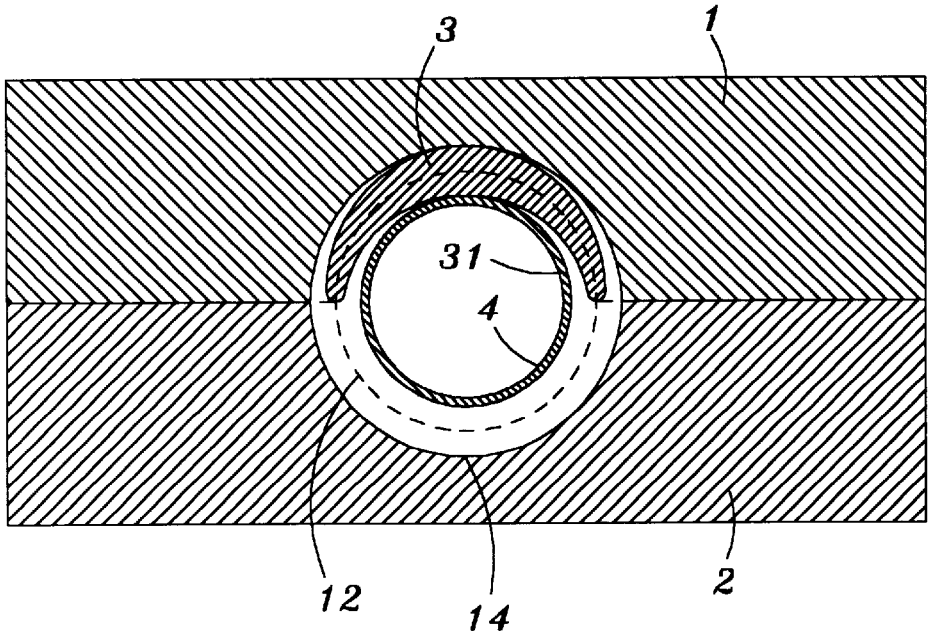
FIG. 3 is a sectional view taken from an A–A' section line in FIG. 2.
Figure 4:
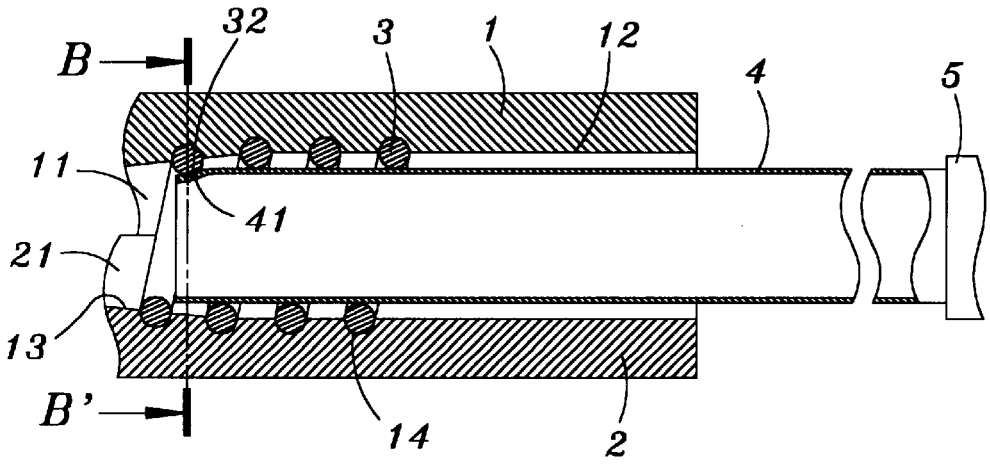
FIG. 4 is a sectional view showing confining and contracting of the pipe during pipe reducing in the present invention.
Figure 5:
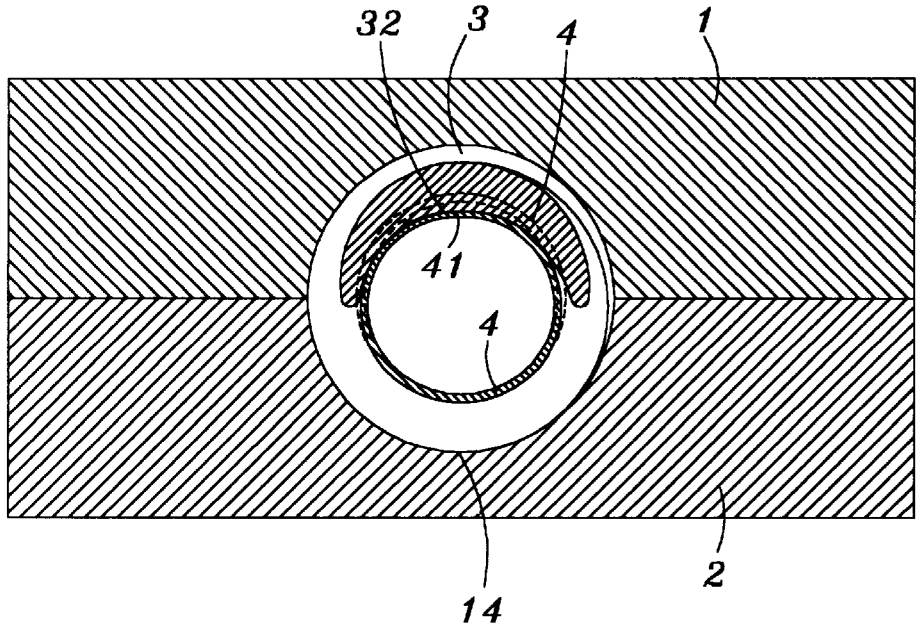
FIG. 5 is a sectional view taken from a B–B' section line in FIG. 4.

When the metallic pipe 4 is under the process of pipe reducing, an oil pressure chuck 5 clamps fixedly the metallic pipe 4 to push it into the half die-cavities 11 and 21 by oil pressure, the metallic pipe 4 thereby is extended with one end thereof into the wall surfaces 31 of the die bodies with constant diameter (as shown in FIG. 2 and 3). At this time, the metallic pipe 4 is slipped in the wall surfaces 31 on the wall sections 12, and direction-guiding function is provided. Then the metallic pipe 4 being guided and fed forwardly stably contacts (with its head end 41) the first met wall surface 32 of the conical spring 3 on a die body with tapering shape (as shown in FIG. 4 and 5); thereby, the peripheral pipe wall of the head end 41 is gradually contracted under confining of the wall surfaces 32 of the conical spring 3 on the die bodies with tapering shapes during feeding of the metallic pipe 4 to form the diameter-reduced pipe section 40 as shown in FIG. 6.

Figure 6:
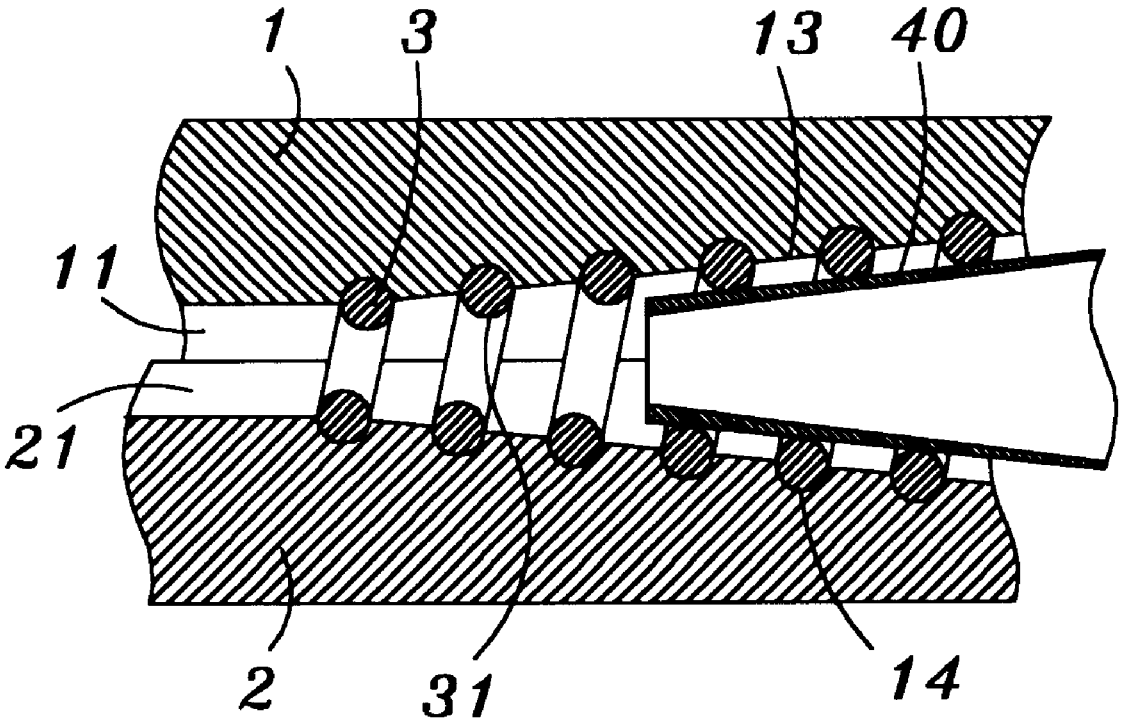
FIG. 6 is a sectional view showing the pipe head formed after confining and contracting in the die cavity of the present invention into a diameter-reduced pipe article.

When the metallic pipe 4 is gradually contracted under confining of the wall surfaces 32, material extruding may result, so that when the process of diameter reducing is completed, the wall at the end of the diameter-reduced pipe section 40 will be thicker (as shown in FIG. 6), this is benefit to giving larger energy absorbing capability and energy transmitting effect to the end of the diameter-reduced pipe section 40.

Further, the wall surfaces 31, 32 are all made from the spiral spring of spring steel, therefore, when low carbon steel alloy pipes or softer pipes made of nonferrous alloy are under contracting, they can have higher wall strength.

And more, in practicing the process of pipe reducing, the pipe wall of the metallic pipe 4 can be treated to have lubricated coating film in pursuance of the requirement of material, quality and speed of processing of the metallic pipe 4, such as by phosphate coating film forming process, zinc stearate coating or lubricant oil coating or immersing of the pipe and the pipe-diameter reducing device together in an oil cooling tank etc., to get better effect of pipe-diameter reducing.

And the pipe-diameter reducing device can do the work of, in addition to reducing a tapered pipe, reducing a straight pipe by changing the shape of the wall surfaces of the spiral spring, the scope of using thereof is very wide. And even when in pipe-diameter reducing, several sets of pipe-diameter reducing devices and chucks can be used on the same machine according to the requirement of yield of production, and multiple pipes can be simultaneously processed for pipe-diameter reducing. Thereby, cost of production can be largely reduced, and effect of competitiveness can be elevated.

In conclusion, the easy mode pipe diameter reducing device of the present invention surely can provide an easier pipe-reducing process for harder or softer metallic pipes in a larger scope, and such a technique of gradual advancing and contracting a pipe wall in taking advantage of the a spiral threaded wall surfaces has never existed in the markets. Therefore, the diameter-reducing device of the present invention belongs to a highly technical area.

Having thus described my invention, what I claim as new and desire to be secured by Letters Patent of the United States is:

1. An easy mode pipe-diameter reducing device comprising:

an oil pressure chuck to clamp a metallic pipe, an upper die body, a lower die body, and a conical spring provided between said upper and lower die bodies, said upper and lower die bodies each comprise a die cavity; wherein each of said die cavities is tapered from a pair of wall sections with a constant diameter inner walls of said die bodies are provided with a series of grooves to receive therein said conical spring, a diameter of said conical spring being larger than a radius of said grooves, such that said conical extends above said inner walls of said die cavities.

* * * * *